US007637069B2

(12) United States Patent
Iri et al.

(10) Patent No.: US 7,637,069 B2
(45) Date of Patent: Dec. 29, 2009

(54) STEEL FRAME BUILDING AND JOINT STRUCTURE OF COLUMN AND BEAM

(75) Inventors: Chika Iri, Chiyoda-ku (JP); Katsunori Ohnishi, Chiyoda-ku (JP)

(73) Assignee: Sekisui Chemical Co., Ltd., Osaka (JP)

( * ) Notice: Subject to any disclaimer, the term of this patent is extended or adjusted under 35 U.S.C. 154(b) by 694 days.

(21) Appl. No.: 10/516,462

(22) PCT Filed: Mar. 18, 2003

(86) PCT No.: PCT/JP03/03282

§ 371 (c)(1),
(2), (4) Date: Dec. 3, 2004

(87) PCT Pub. No.: WO03/104578

PCT Pub. Date: Dec. 18, 2003

(65) Prior Publication Data

US 2005/0247007 A1 Nov. 10, 2005

(30) Foreign Application Priority Data

Jun. 5, 2002 (JP) ..... 2002-164473

(51) Int. Cl.
*E04H 12/00* (2006.01)
*E04C 2/38* (2006.01)

(52) U.S. Cl. ..... 52/655.1; 52/656.9

(58) Field of Classification Search ..... 52/633, 52/655.1, 653.1, 656.9
See application file for complete search history.

(56) References Cited

U.S. PATENT DOCUMENTS 3,952,472 A * 4/1976 Boehmig ..... 52/655.1
6,073,405 A 6/2000 Kasai et al.
6,430,890 B1 * 8/2002 Chiwhane et al. ..... 52/715
7,127,862 B2 * 10/2006 Saldana ..... 52/715

FOREIGN PATENT DOCUMENTS

| | | |
|---|---|---|
| JP | SHO-48-47104 | 7/1973 |
| JP | SHO-53-16617 | 2/1978 |
| JP | SHO-62-120602 | 7/1987 |

(Continued)

OTHER PUBLICATIONS

International Search Report for PCT/JP03/03282 dated Apr. 15, 2003.

*Primary Examiner*—Richard E Chilcot, Jr.
*Assistant Examiner*—Jessica Laux
(74) *Attorney, Agent, or Firm*—Sughrue Mion, PLLC

(57) ABSTRACT

A steel-framed building 1 using section steels for a column 10 and a beam 20, wherein section steels having the same cross sections are used for the column 10 and the beam 20. The steel-framed building 1 has a beam-side joint A for joining an end of the column 10 to the beam 20, and a column-side joint B for joining an end of the beam 20 to the column 10. The same members are used as both a reinforcing member 30 provided in the cross section of the beam 20 constituting the beam-side joint A and a reinforcing member 30 provided in the cross section of the column 10 constituting the column-side joint B.

7 Claims, 10 Drawing Sheets

FOREIGN PATENT DOCUMENTS

| | | | |
|---|---|---|---|
| JP | 2-229339 | A | 9/1990 |
| JP | 04-044545 | | 2/1992 |
| JP | 4-44545 | A | 2/1992 |
| JP | HEI-04-044545 | | 2/1992 |
| JP | HEI-04-339936 | | 11/1992 |
| JP | 6-17507 | A | 1/1994 |
| JP | 11-093258 | | 4/1999 |
| JP | HEI-11-324129 | | 11/1999 |
| JP | 2000-226890 | | 8/2000 |
| JP | 2000-291139 | | 10/2000 |

* cited by examiner (A)

(B)

(A)

(B)

STEEL FRAME BUILDING AND JOINT STRUCTURE OF COLUMN AND BEAM

TECHNICAL FIELD

The present invention relates to a steel-framed building and a joint structure between column and beam.

BACKGROUND TECHNIQUE

Japanese Patents Nos. 2,992,580 and 2,992,581 disclose a steel-framed building constructed by joining a column and a beam. However, these conventional techniques do not disclose that section steels having the same cross section are used for the column and the beam, the number of kinds of section steels to be used is undesirably increased, and building costs are increased. Further, a reinforcing member provided in a cross section of the beam constituting a beam-side joint and a reinforcing member provided in a cross section of the column constituting a column-side joint can not be formed as the same members. The number of kinds of reinforcing members to be used is undesirably increased, and building costs are increased.

Japanese Patent Application Laid-open No. H11-324129 discloses that a reinforcing member is joined to a cross section of a beam in a beam-side joint by a bolt. An end of a column is joined to a reinforcing member by a bolt, thereby employing a dry joint structure which does not need welding. However, this conventional technique does not disclose that the dry joint structure which need not be welded is employed in a column-side joint. Therefore, in the column-side joint, a horizontal stiffener is welded to the column, and the end of the beam is joined to the horizontal stiffener. The column may be bent due to thermal influence of the welding, and a special device such as an assembling jig is required for welding the stiffener.

DISCLOSURE OF THE INVENTION

It is an object of the present invention to reduce the number of kinds of section steels to be used in a steel-framed building which uses section steels for a column and a beam.

It is another object of the invention to reduce the number of kinds of reinforcing members used for a joint between a column and a beam in a steel-framed building which uses section steels for the column and the beam.

It is another object of the invention to employ a dry joint structure which does not use welding in a column-side joint.

According to the present invention, there is disclosed a steel-framed building using section steels for a column and a beam, wherein section steels having the same cross sections are used for the column and the beam. The steel-framed building has a beam-side joint for joining an end of the column to the beam, and a column-side joint for joining an end of the beam to the column. The same members are used as both a reinforcing member provided in the cross section of the beam constituting the beam-side joint and a reinforcing member provided in the cross section of the column constituting the column-side joint.

According to the present invention, there is disclosed a joint structure of column-side joint for joining an end of a beam to a column, wherein a reinforcing member is joined to a cross section of the column by a bolt, and an end of the beam is joined to the reinforcing member by a bolt.

BEST MODE FOR CARRYING OUT THE INVENTION

Figure 1:
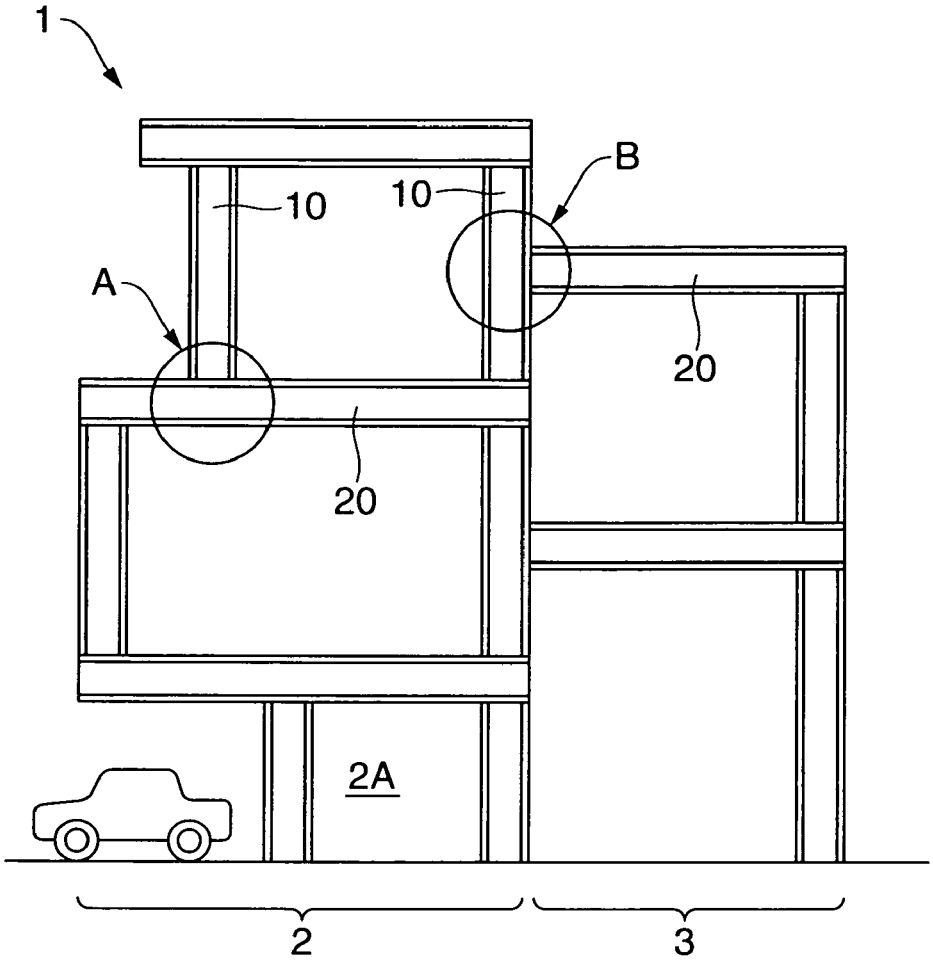
FIG. 1 shows one example of a steel-framed building, wherein (A) is a side view thereof and (B) is a sectional view showing a section steel of a column and a beam.
Figure 1:
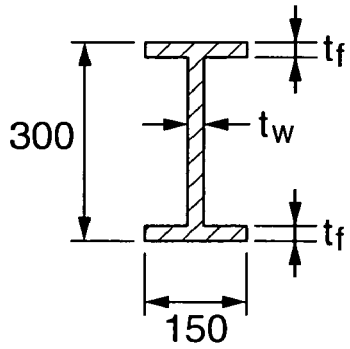

As shown in FIG. 1, in a steel-framed building 1, H section steels are used for columns 10 and beams 20, comprising a high floor portion 2 on which the height of each floor is high so that a garage 2A can be provided, and a standard floor portion 3 on which a height of each floor is standard level.

In the steel-framed building 1, the beam level of the high floor portion 2 and the beam level of the standard floor portion 3 are different in height, and the high floor portion 2 and the standard floor portion 3 are integrally formed. In the high floor portion 2 and the standard floor portion 3, a joint A between the beam 20 and an upper or lower end of the column 10 is a beam-side joint A which joints an end of the column 10 to the beam 20. Alternately, in a jointed portion between the high floor portion 2 and the standard floor portion 3, if a joint B between the column 10 and the beam 20 is a beam-side joint, the column 10 is cut by the beam 20 and costs are increased. Therefore, a column-side joint B which joins the end of the beam 20 to a side of the column 10 is used.

In the steel-framed building 1, H section steels having the same cross sections are used for the column 10 and the beam 20. As shown in FIG. 1(B), for example, the cross section of the H section steel has a height of 300 mm, a width of 150 mm, the thickness of a web is tw and the flange thickness is tf (two or more values of tw and tf may be utilized).

In the steel-framed building 1, H section steels having the same cross sections are used for the column 10 and the beam 20. Therefore, the same members can be used as both a reinforcing member 30 provided in the cross section of the beam 20 constituting the beam-side joint A, and a reinforcing member 30 provided in the cross section of the column 10 constituting the column-side joint B.

The reinforcing members 30 are used such that the reinforcing member 30 is mounted to opposite sides of the web w of the H section steel in the cross section of the beam 20 in the beam-side joint A. The reinforcing member 30 is also mounted to opposite sides of the web w of the H section steel in the cross section of the column 10 in the column-side joint B.

Figure 2:
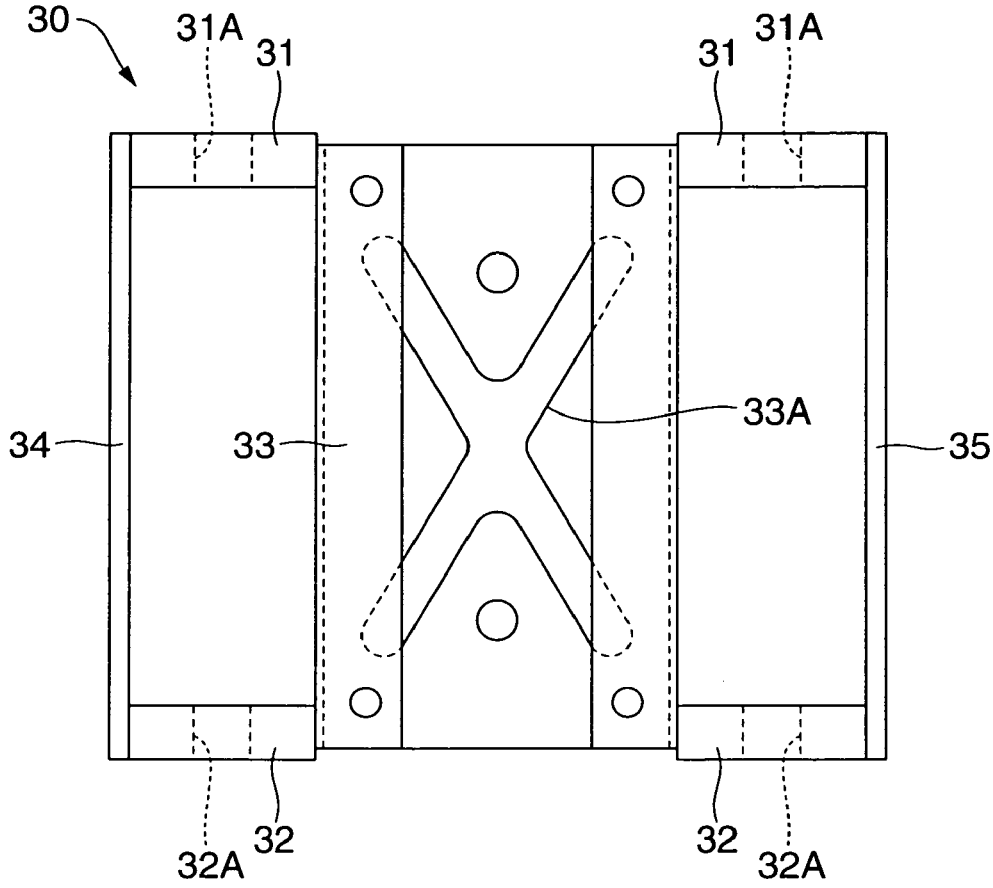
FIG. 2 shows a reinforcing member commonly used for a beam-side joint and a column-side joint, wherein (A) is a front view thereof and (B) is a plan view thereof.
Figure 2:
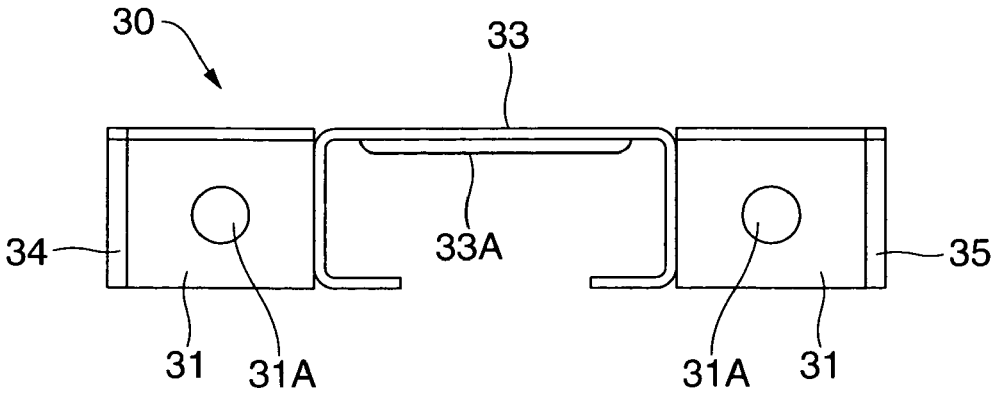
Figure 3:
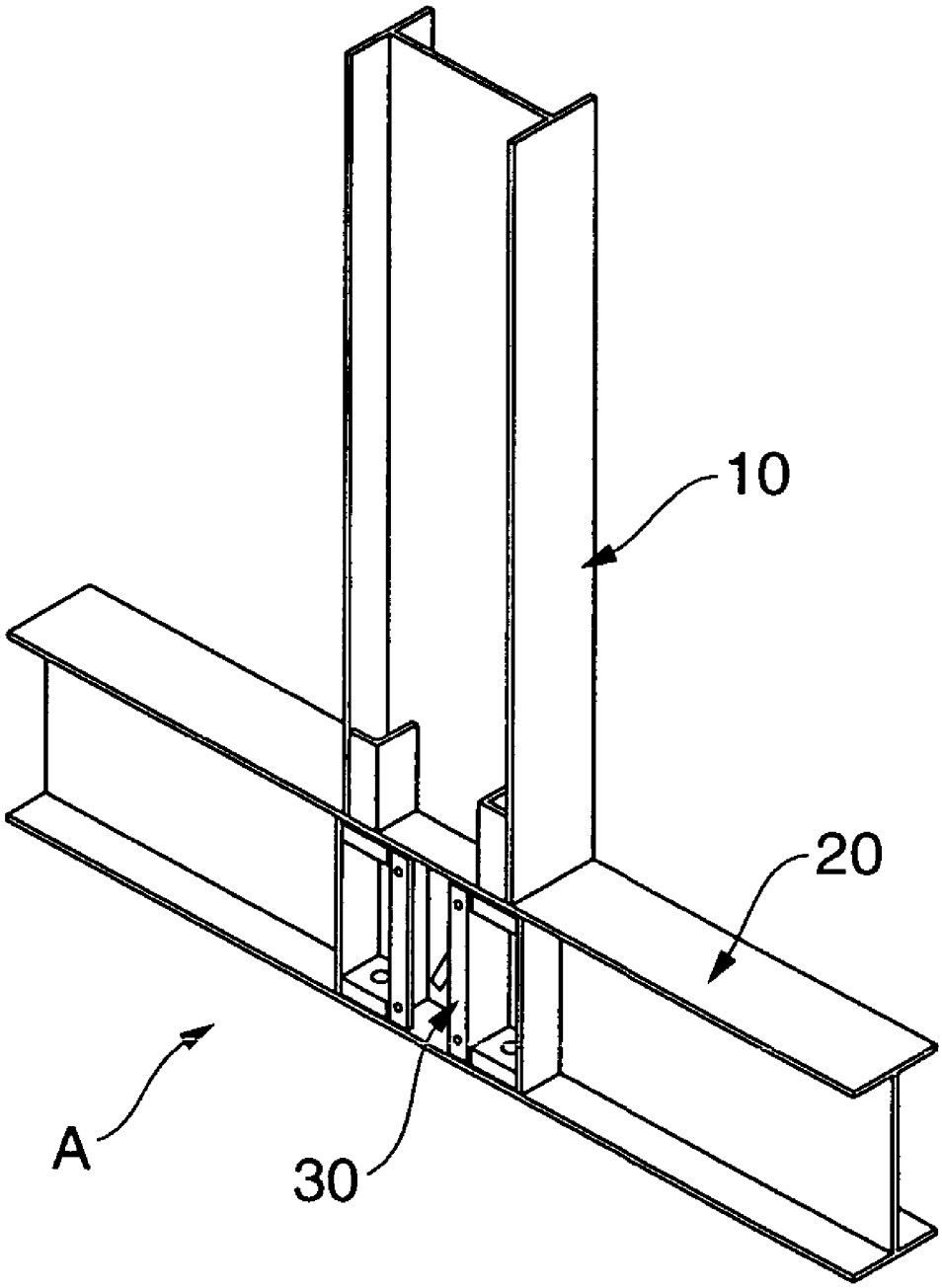
FIG. 3 is a perspective view showing a beam-side joint.
Figure 4:
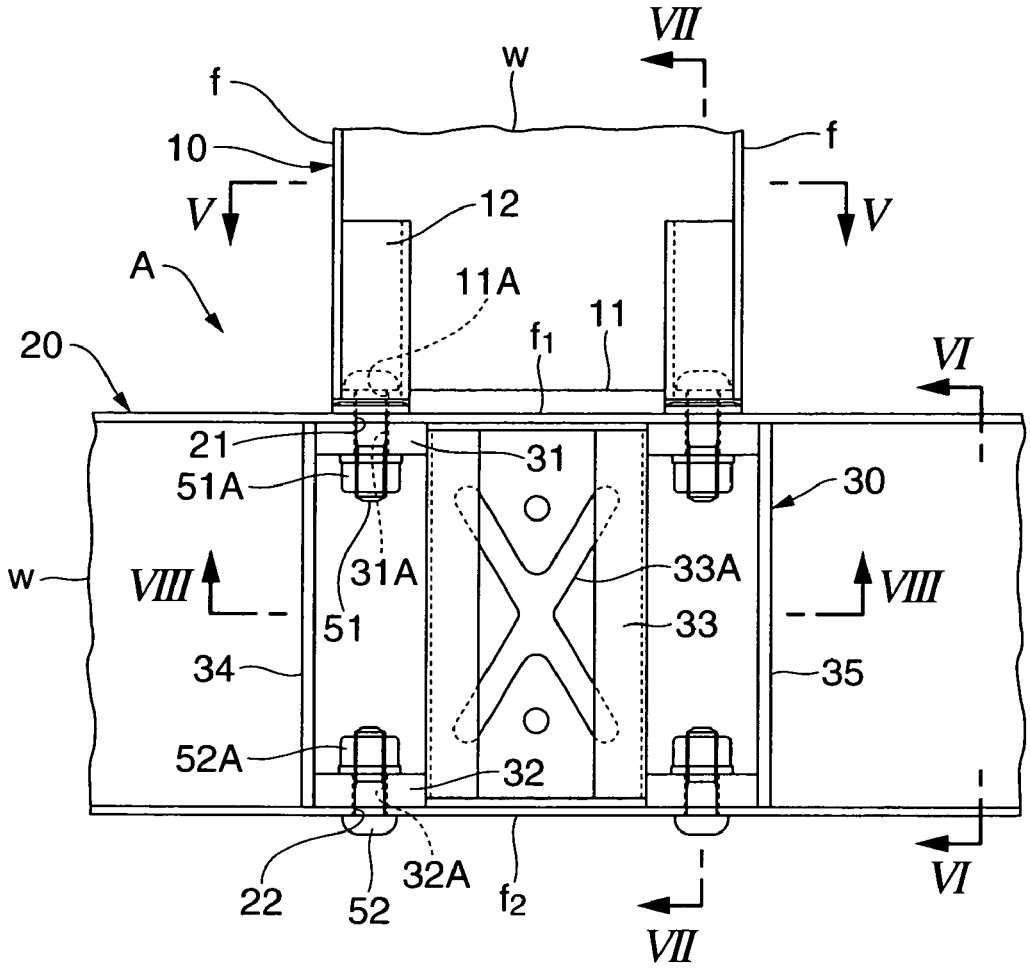
FIG. 4 is a front view showing the beam-side joint.
Figure 5:
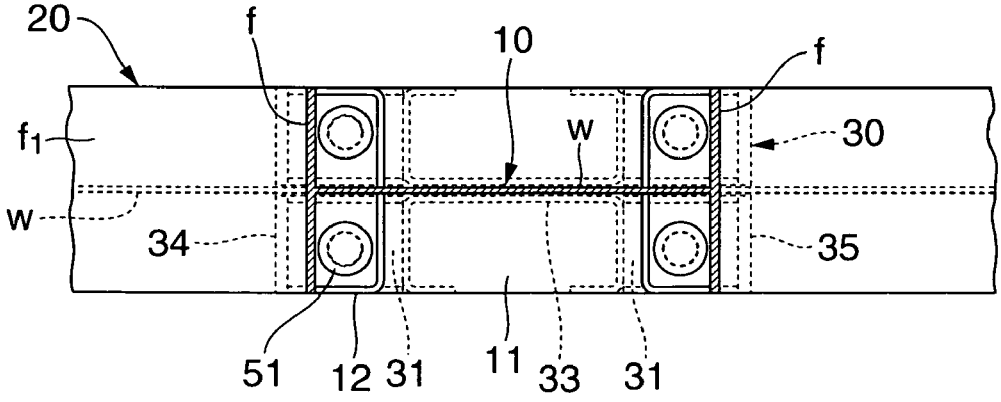
FIG. 5 is a sectional view taken along a V-V line in FIG. 4.
Figure 6:
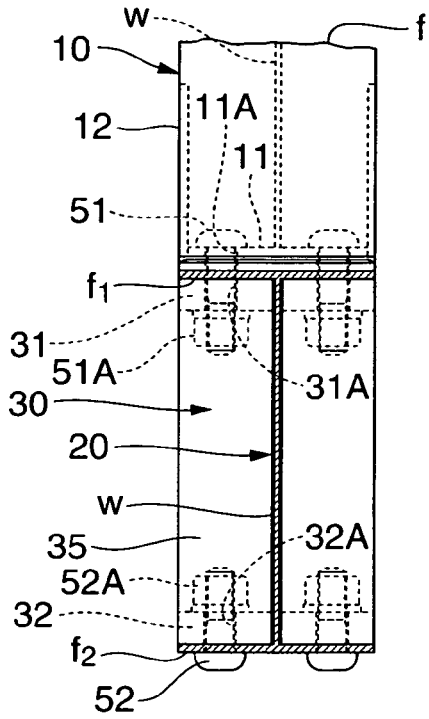
FIG. 6 is a sectional view taken along a VI-VI line in FIG. 4.
Figure 7:
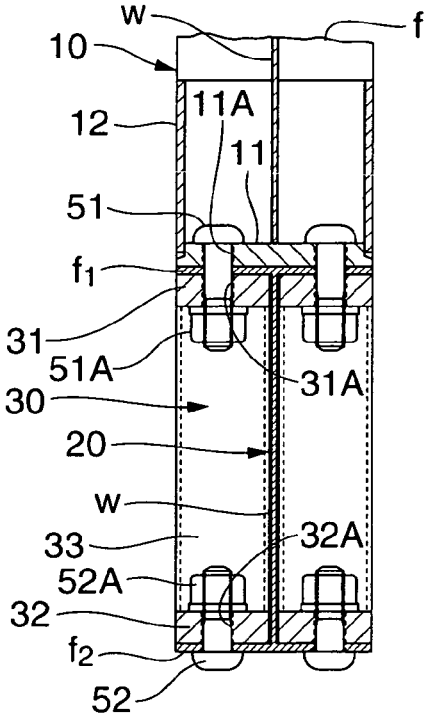
FIG. 7 is a sectional view taken along a VII-VII line in FIG. 4.
Figure 8:
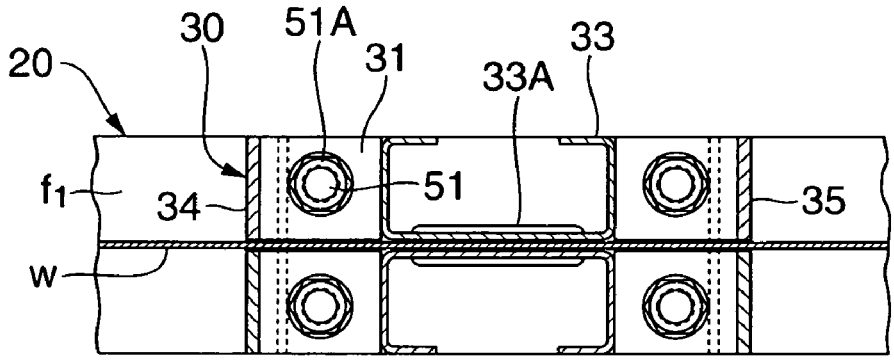
FIG. 8 is a sectional view taken along a VIII-VIII line in FIG. 4.
Figure 9:
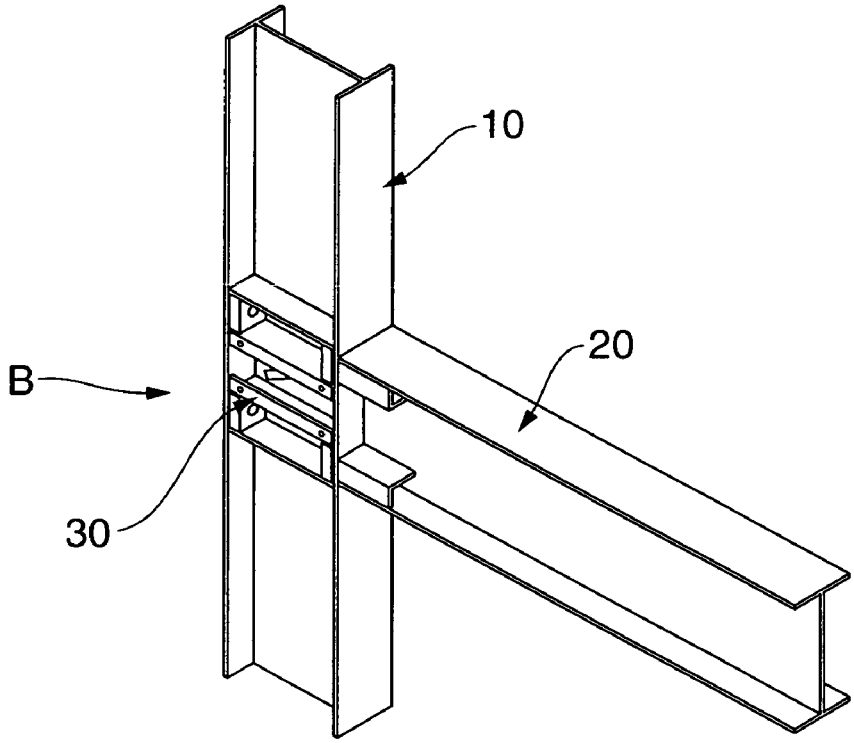
FIG. 9 is a perspective view showing a column-side joint.
Figure 10:
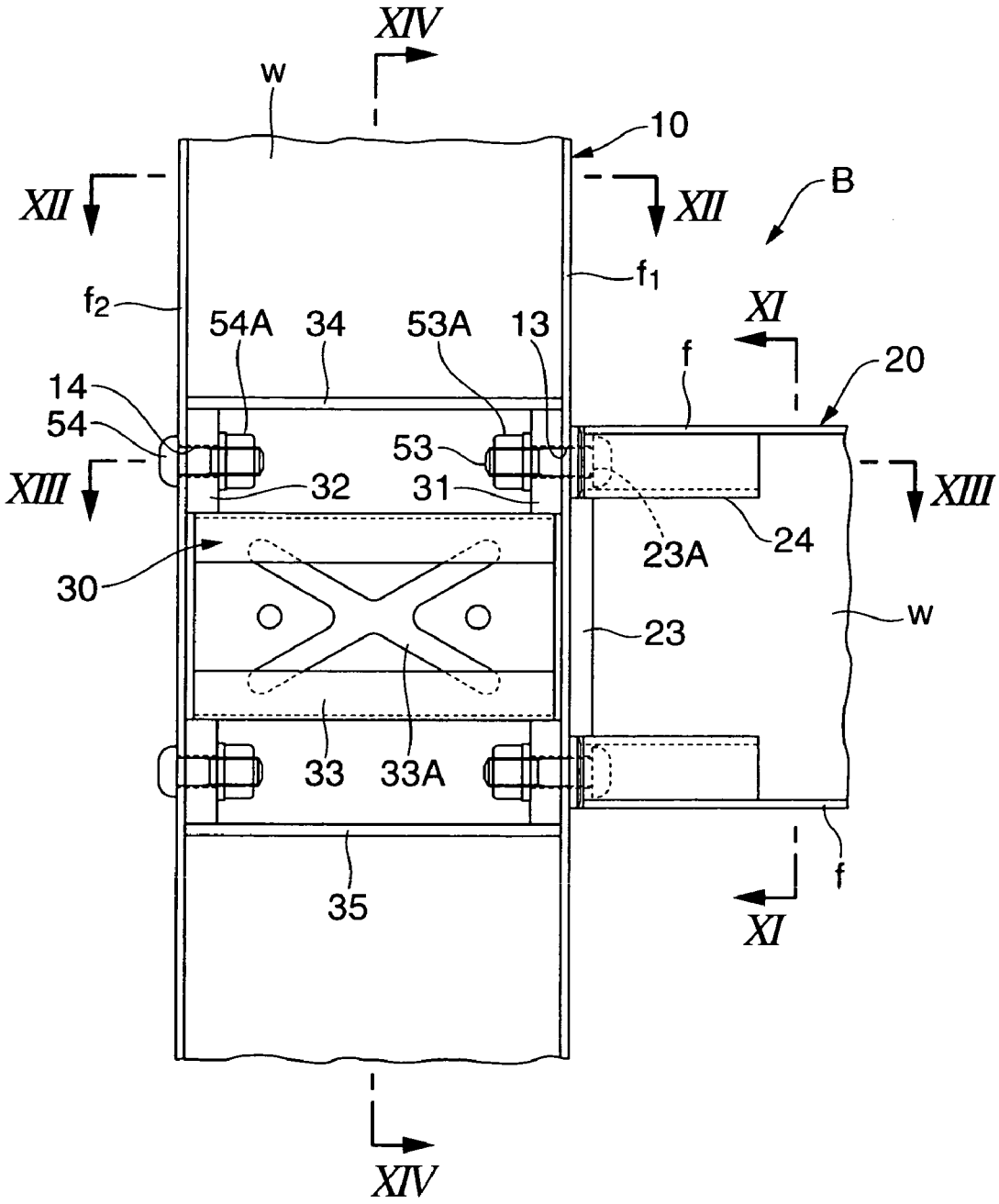
FIG. 10 is a front view showing the column-side joint.
Figure 11:
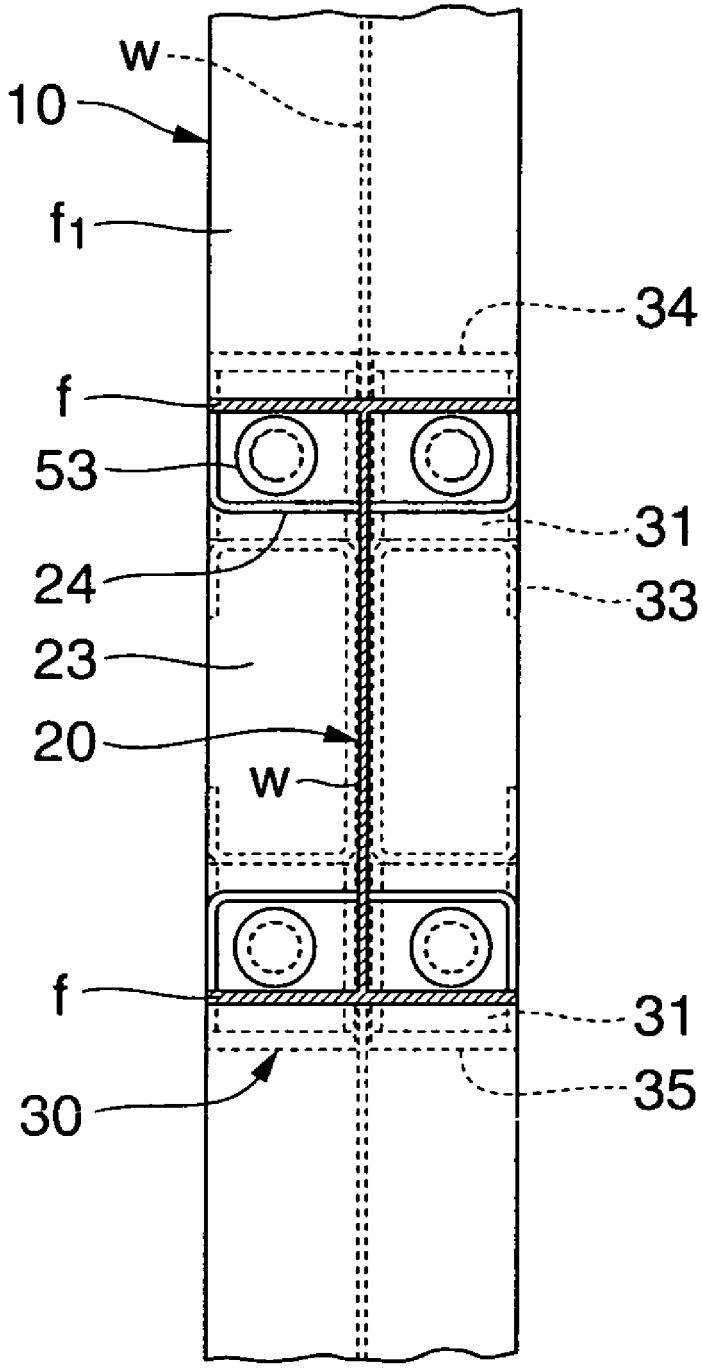
FIG. 11 is a sectional view taken along an XI-XI line in FIG. 10.
Figure 12:
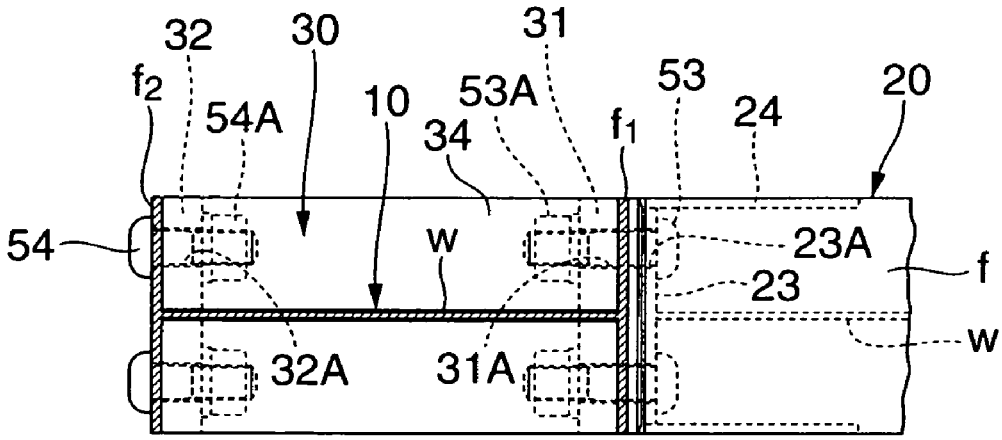
FIG. 12 is a sectional view taken along an XII-XII line in FIG. 10.
Figure 13:
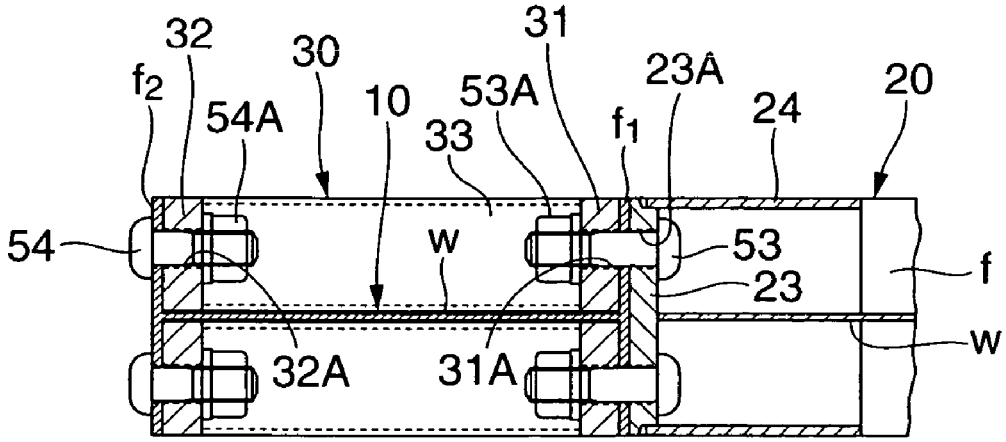
FIG. 13 is a sectional view taken along an XIII-XIII line in FIG. 10.
Figure 14:
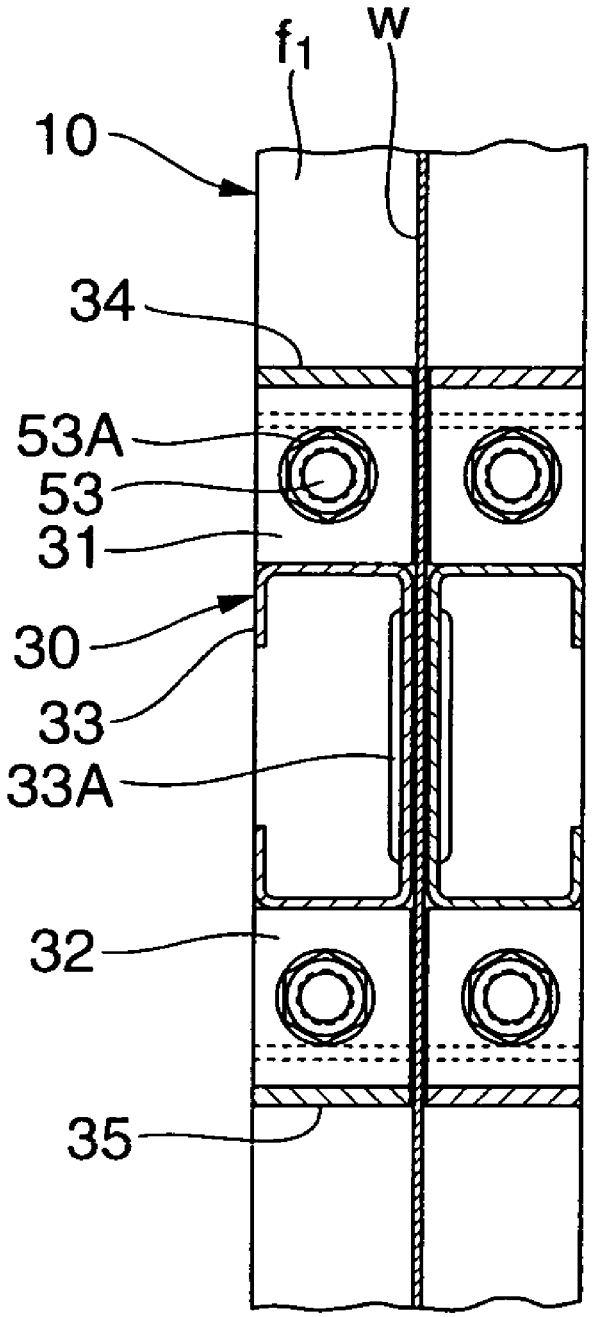
FIG. 14 is a sectional view taken along an XIV-XIV line in FIG. 10.

As shown in FIG. 2, the reinforcing member 30 comprises two end plates 31 and 32 on opposite ends of the reinforcing member 30, a central groove-type plate 33 as a connecting member for connecting both of the end plates 31 and 32 to each other, and stiffener plates 34 and 35 on opposite sides of the reinforcing member 30. The groove-type plate 33 is provided at its web with an X-like strengthening rib 33A. Inner side surfaces of left and right end plates 31 are welded to opposite sides (flanges) on one end side of the groove-type plate 33. Inner side surfaces of left and right end plates 32 are welded to opposite sides (flanges) on the other end side of the groove-type plate 33. An outer surface of the left end plate 31 is welded to a side on the one end side of the stiffener plate 34. An outer surface of the left end plate 32 is welded to a side of the other end side of the stiffener plate 34. An outer surface of the right end plate 31 is welded to a side of the one end side of the stiffener plate 35. An outer surface of the right end plate 32 is welded to a side of the other end side of the stiffener plate 35. The left and right end plates 31 are provided with one bolt-insertion hole 31A, and the left and right end plates 32 are provided with one bolt-insertion hole 32A.

A joint structure between the beam-side joint A and the column-side joint B using the reinforcing member 30 will be explained below.

Beam-Side Joint A (FIGS. 3 to 8)

On opposite sides of the web w in a portion constituting the beam-side joint A in a longitudinal direction of the beam 20, an upper flange f1, or a lower flange f2, is provided with two bolt-mounting holes 21, corresponding to bolt-insertion holes 31A of the left and right end plates 31 of the reinforcing member 30. A lower flange f2, or an upper flange f1, is provided with two bolt-mounting holes 22, corresponding to bolt-insertion holes 32A of the left and right end plates 32 of the reinforcing member 30. Alternatively, planned portions of a plurality of beam-side joints A which are predetermined in the longitudinal direction of the beam 20 may be provided with bolt-mounting holes 21 and 22. One selection of the plurality of planned portions may be employed as the beam-side joint A of this embodiment.

End plate 11 is welded to an end (an upper end or lower end) of the column 10 which constitutes the beam-side joint A. In the end plate 11, each of the opposite sides of the web w of the column 10 is provided with two bolt-insertion holes 11A, corresponding to the bolt-insertion holes 31A of the left and right end plates 31 of the reinforcing member 30. In the end plate 11, an L-shaped plate 12 stands on a periphery of each the bolt-insertion holes 11A. The L-shaped plate 12 has an L-shaped cross section, and one end thereof is welded to the end plate 11. One side of the L-shaped plate 12 is welded to the web w of the column 10, and the other side of the L-shaped plate 12 is welded to an outer edge of the flange f of the column 10. A bolt-insertion space (insertion space of a bolt 51) of the L-shaped plate 12 surrounded between the flange f and the web w of the column 10, is opened toward the other end.

The beam-side joint A is constructed according to the following procedure:

(1) In a portion of the beam 20, which constitutes the beam-side joint A, one reinforcing member 30 is mounted to each of the opposite sides of the web w of the beam 20. Groove-type plates 33 of the reinforcing members 30 are respectively mounted to opposite sides of the web w of the beam 20 such that the groove-type plates 33 are added. Both the end plates 31 and 32 of the reinforcing member 30 are added to both the flanges f1 and f2 of the beam 20.

(2) End plate 11 of the column 10 is butted against the flange f1 of the beam 20. Bolt 51, which may be a high-strength bolt, is inserted through the bolt-insertion hole 11A of the end plate 11 of the column 10, the bolt-mounting hole 21 of the flange f1 of the beam 20, and the bolt-insertion hole 31A of the end plate 31 of the reinforcing member 30. The end plate 11 of the column 10, the flange f1 of the beam 20, and the end plate 31 of the reinforcing member 30 are connected and fastened to each other by a nut 51A which is threadedly engaged with bolt 51.

(3) Bolt 52, which may be a high-strength bolt, is inserted through flange f2 of the beam 20 and the bolt-insertion hole 32A of end plate 32 of the reinforcing member 30. Flange f2 of the beam 20 and end plate 32 of the reinforcing member 30 are connected and fastened to each other by a nut 52A which is threadedly engaged with bolt 52.

The fastening force of bolt 51 is set such that the end plate 11 of the column 10 is not opened from the flange f1 of the beam 20 by a moment applied to the beam-side joint A.

Column-Side Joint B (FIGS. 9 to 14)

On opposite sides of the web w in a portion constituting the column-side joint B in a longitudinal direction of column 10, a right flange f1, or a left flange f2, is provided with two bolt-mounting holes 13, corresponding to bolt-insertion holes 31A of the left and right end plates 31 of the reinforcing member 30. A left flange f2, or a right flange f1, is provided with two bolt-mounting holes 14, corresponding to bolt-insertion holes 32A of the left and right end plates 32 of the reinforcing member 30. Alternatively, planned portions of a plurality of column-side joints B which are predetermined in the longitudinal direction of the column 10 may be provided with the bolt-mounting holes 13 and 14. One of the plurality of planned portions may be employed as the column-side joint B of this embodiment.

End plate 23 is welded to an end (left end or right end) of the beam 20 which constitutes the column-side joint B. In the end plate 23, each of the opposite sides of the web w of the beam 20 is provided with two bolt-insertion holes 23A, corresponding to the bolt-insertion holes 31A of the left and right end plates 31 of the reinforcing member 30. In the end plate 23, an L-shaped plate 24 stands on the periphery of each the bolt-insertion holes 23A. The L-shaped plate 24 has an L-shaped cross section, and one end thereof is welded to the end plate 23. One side of the L-shaped plate 24 is welded to the web w of the beam 20, and the other side of the L-shaped plate 24 is welded to an outer edge of the flange f of the beam 20. A bolt-insertion space (insertion space of bolt 53) of the L-shaped plate 24 surrounded between the flange f and the web w of the beam 20, is opened toward the other end.

The column-side joint B is constructed according to the following procedure:

(1) In a portion of column 10, which constitutes the column-side joint B, one reinforcing member 30 is mounted to each of the opposite sides of the web w of column 10. Groove-type plates 33 of the reinforcing members 30 are respectively mounted to opposite sides of the web w of the column 10 such that the groove-type plates 33 are added. Both of the end plates 31 and 32 of the reinforcing member 30 are added to both of the flanges f1 and f2 of the column 10.

(2) End plate 23 of the beam 20 is butted against flange f1 of column 10. Bolt 53, which may be a high-strength bolt is inserted through the bolt-insertion hole 23A of end plate 23 of beam 20, the bolt-mounting hole 13 of flange f1 of column 10, and the bolt-insertion hole 31A of the end plate 31 of the reinforcing member 30. End plate 23 of the beam 20, flange f1 of the column 10, and end plate 31 of the reinforcing member 30 are connected and fastened to each other by a nut 53A which is threadedly engaged with bolt 53.

(3) Bolt 54, which may be a high-strength bolt, is inserted through flange f2 of column 10 and the bolt-insertion hole 32A of end plate 32 of reinforcing member 30. Flange f2 of column 10 and the end plate 32 of reinforcing member 30 are connected and fastened to each other by a nut 54A which is threadedly engaged with bolt 54.

The fastening force of bolt 53 is set such that the end plate 23 of the beam 20 is not opened from the flange f1 of column 10 by a moment applied to the column-side joint B.

The following effects can be obtained by the present embodiment.

(1) H section steels having the same cross sections are used for column 10 and the beam 20 constituting the steel-framed building 1. Therefore, the number of kinds of the H section steels to be used can be reduced, and the construction costs can also be reduced.

(2) The H section steels constituting the column 10 and the beam 20 have the same cross sections. Therefore, the same members can be used as both a reinforcing member 30 provided in the cross section of the beam 20 constituting the beam-side joint A, and a reinforcing member 30 provided in the cross section of the column 10 constituting the column-side joint B. Thus, the number of kinds of the reinforcing member 30 to be used can be reduced, and the construction costs can likewise also be reduced.

(3) In the beam-side joint A, the reinforcing member 30 is joined with the cross section of beam 20 by a bolt, and an end of the column 10 is joined with the reinforcing member 30 by a bolt. Therefore, a dry joint structure using no welding can be employed. With this, the column is not bent due to thermal influence of the welding, and it is possible to easily construct the beam-side joint A. A position of column 10 can freely be selected on each floor, and a floor plan can freely be selected on each floor. Even if construction of the structure is completed, a position of the column 10 and a width of a window can be changed. Further, a running column is not necessary. The column 10 can be shortened in length, construction of the structure can be completed with a small truck and a small wrecker, and the structure can be completed on a site facing a narrow road or on a small site.

(4) Reinforcing member 30 is joined with the cross section of the column 10 by a bolt in the column-side joint B, and an end of the beam 20 is joined with the reinforcing member 30 by a bolt. Thus, a dry joint structure using no welding can be employed. With this, the column is not bent due to thermal influence of the welding, and it is possible to easily constitute the column-side joint B. A position of the beam 20 can freely be selected on each floor, and a floor plan can freely be selected on each floor. Even if construction of the structure is completed, the position of the beam 20 and the width of a window can be changed. Further, a running beam is unnecessary and the beam 20 can be shortened in length. Construction of the structure can be completed with a small truck and a small wrecker, and the structure can be completed on a site facing a narrow road or on a small site.

(5) The reinforcing member 30 may have a box-like shape, and may be provided at its opposite ends with the end plates 31 and 32 as well as connecting members (groove-type plates 33 and the stiffener plates 34 and 35) for connecting the end plates. The reinforcing member 30 itself has high rigidity. Therefore, the joint portion of the beam 20 in which the end plates 31 and 32 on opposite ends of the reinforcing member 30 are connected to both the flanges f1 and f2 of the column 10 by a bolt has high joint strength.

Although the embodiment of the present invention has been described in detail based on the drawings, the structure of the invention is not limited to the embodiment, and modifications in design not departing from the subject matter of the invention are also included in the invention. For example, section steels of the column and the beam are not limited to the H section steel, and other section steel such as C section steels can also be used. Other forms may be employed for the reinforcing member.

INDUSTRIAL APPLICABILITY

According to the present invention, in a steel-framed building using column and beam construction, it is possible to reduce the number of kinds of section steels to be used. According to the invention, in a steel-framed building using column and beam construction, it is possible to reduce the number of kinds of reinforcing members to be used for a joint between a column and a beam. Further, according to the invention, a dry joint structure using no welding can be employed in a column-side joint.

What is claimed is:

1. A steel-framed building using section steels having the same cross sections used for a column and a beam, having a joint for the beam in an end of the column, and having a joint for the column in an end of the beam, wherein a beam-side joint for joining an end of the column to the beam, and a column-side joint for joining the end of the beam to the column, and the same members are used as both a reinforcing member disposed at a cross section of the beam as a beam-side joint, and a reinforcing member disposed at a the cross section of the column as a column-side joint, the reinforcing member disposed at a cross section of the beam as the beam-side joint comprising two first end plates disposed in an upper end side, two second end plates disposed in a lower end side, a groove-type plate disposed at a central portion as a connecting member connecting the first and the second end plates, and stiffener plates disposed at left and right opposite outer sides of the first and the second end plates, the reinforcing member disposed at a cross section of the column as a column-side joint comprising two first end plates disposed at one side of the left and right sides, two second end plates disposed at the other side of the left and right sides, a groove-type plate disposed at a central portion as a connecting member connecting the first and the second end plates, and stiffener plates disposed at upper and lower opposite outer sides of the first and the second end plates.

2. A steel-framed building according to claim 1, wherein in the beam-side joint, the reinforcing member is jointed within the cross section of the beam by a bolt, and an end of the column is joined with the reinforcing member by a bolt, in the column-side joint, the reinforcing member is joined in the cross section of the column by a bolt, and an end of the beam is jointed to the reinforcing member by a bolt.

3. A steel-framed building according to claim 1, wherein a bolt-mounting hole is previously provided in each of the planned portions of a plurality of beam-side joints or column-side joints preset in a longitudinal direction of the beam or column, selected one of the plurality of planned portions is employed as a beam-side joint or column-side joint of this time.

4. A joint structure of a column and a beam joining an end of a beam to a column, wherein a reinforcing member is joined within a cross section of the column by a bolt, and an end plate disposed at an end of the beam is joined with the reinforcing member by a bolt, the reinforcing member has two first end plates in one of the left and right sides, two second end plates in the other of the left and right sides, a groove-type plate disposed at a central portion as a connecting member connecting the first and the second end plates, and a stiffener plates disposed at upper and lower opposite outer sides of the first and second end plates.

5. A joint structure of a column and a beam according to claim 4, wherein the reinforcing member having end plates at its opposite ends, and a connecting member for connecting the end plates to each other, the end plate on one end side being joined with one of the flanges of the column by a bolt, and the end plate on the other end side being joined with the other flange of the column by a bolt.

6. A joint structure of a column and a beam according to claim 5, wherein the groove-type plate is welded at its each of the upper and lower opposite sides in one of the left and right sides to an inner surface of the first end plate, and is welded at its each of the upper and lower opposite sides in the other of the left and right sides to an inner surface of the second end plate, an upper stiffener plate is welded at its side in one of the left and right sides to the outer side surface of the upper first end plate, and is welded at its side in the other of left and right sides to outer side surface of the upper second end plate, an lower stiffener plate is welded at its side in one of the left and right sides to the outer side surface of the lower first end plate, and is welded at its side in the other of left and right sides to outer side surface of the lower second end plate.

7. A joint structure of a column and a beam according to claim 6, wherein the groove-type plate has an X-shaped strengthening rib.

* * * * *